US006898566B1

(12) United States Patent
Benyassine et al.

(10) Patent No.: US 6,898,566 B1
(45) Date of Patent: May 24, 2005

(54) USING SIGNAL TO NOISE RATIO OF A SPEECH SIGNAL TO ADJUST THRESHOLDS FOR EXTRACTING SPEECH PARAMETERS FOR CODING THE SPEECH SIGNAL

(75) Inventors: Adil Benyassine, Irvine, CA (US); Huan-Yu Su, San Clemente, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 841 days.

(21) Appl. No.: 09/640,841

(22) Filed: Aug. 16, 2000

(51) Int. Cl.[7] ..... G10L 21/02; G10L 11/04
(52) U.S. Cl. ..... 704/226; 704/207
(58) Field of Search ..... 704/200, 200.1, 704/226–228, 207, 208, 214, 215

(56) References Cited

U.S. PATENT DOCUMENTS 4,630,305 A 12/1986 Borth et al.
4,811,404 A * 3/1989 Vilmur et al. ..... 704/226
5,214,741 A * 5/1993 Akamine et al. ..... 704/226
5,668,927 A 9/1997 Chan et al.
5,727,073 A 3/1998 Ikeda
5,742,734 A * 4/1998 DeJaco et al. ..... 704/226
5,911,128 A * 6/1999 DeJaco ..... 704/200.1
5,963,901 A 10/1999 Vahatalo et al.
5,991,718 A 11/1999 Malah

* cited by examiner

*Primary Examiner*—David D. Knepper
(74) *Attorney, Agent, or Firm*—Farjami & Farjami LLP

(57) ABSTRACT

There are provided speech coding methods and systems for estimating a plurality of speech parameters of a speech signal for coding the speech signal using one of a plurality of speech coding algorithms, the plurality of speech parameters includes pitch information, the plurality of speech parameters is calculated using a plurality of thresholds. An example method includes estimating a background noise level in the speech signal to determine a signal to noise ratio (SNR) for the speech signal, adjusting one or more of the plurality of thresholds based on the SNR to generate one or more SNR adjusted thresholds, analyzing the speech signal to extract the pitch information using the one or more SNR adjusted thresholds, and repeating the estimating, the adjusting and the analyzing to code the speech signal using one the plurality of speech coding algorithms.

12 Claims, 8 Drawing Sheets

USING SIGNAL TO NOISE RATIO OF A SPEECH SIGNAL TO ADJUST THRESHOLDS FOR EXTRACTING SPEECH PARAMETERS FOR CODING THE SPEECH SIGNAL

FIELD OF INVENTION

The present invention relates generally to a method for improved speech coding and, more particularly, to a method for speech coding using the signal to ratio (SNR).

BACKGROUND OF THE INVENTION

With respect to speech communication, background noise can include vehicular, street, aircraft, babble noise such as restaurant/cafe type noises, music, and many other audible noises. How noisy the speech signal is depends on the level of background noise. Because most cellular telephone calls are made at locations that are not within the control of the service provider, a great deal of noisy speech can be introduced. For example, if a cell phone rings and the user answers it, speech communication is effectuated whether the user is in a quiet park or near a noisy jackhammer. Thus, the effects of background noise are a major concern for cellular phone users and providers.

In the telecommunication industry, speech is digitized and compressed per ITU (International Telecommunication Union) standards, or other standards such as wireless GSM (global system for mobile communications). There are many standards depending upon the amount of compression and application needs. It is advantageous to highly compress the signal prior to transmission because as the compression increases, the bit rate decreases. This allows more information to transfer in the same amount of bandwidth thereby saving bandwidth, power and memory. However, as the bit rate decreases, speech recovery becomes increasingly more difficult. For example, for telephone application (speech signal with frequency bandwidth of around 3.3 kHz) digital speech signal is typically 16 bits linear or 128 kbits/s. ITU-T standard G.711 is operating at 64 kbits/s or half of the linear PCM (pulse coding modulation) digital speech signal. The standards continue to decrease in bit rate as demands for bandwidth rise (e.g., G.726 is 32 kbits/s; G.728 is 16 kbits/s; G.729 is 8 kbits/s). A standard is currently under development which will decrease the bit rate even lower to 4 kbits/s.

Typically speech coding is achieved by first deriving a set of parameters from the input speech signal (parameter extraction) using certain estimation techniques, and then applying a set of quantization schemes (parameter coding) based on another set of techniques, such as scalar quantization, vector quantization, etc. When background noise is in the environment (e.g., additive speech and noise at the same time), the parameter extraction and coding becomes more difficult and can result in more estimation errors in the extraction and more degradation in the coding. Therefore, when the signal to noise ratio (SNR) is low (i.e., noise energy is high), accurately deriving and coding the parameters is more challenging.

Previous solutions for coding speech in noisy environments attempts to find one compromise set of techniques for a variety of noise levels and noise types. These techniques use one set of non-varying or static decision mechanisms with controlling parameters (thresholds) calculated over a broad range of noises. It is difficult to accurately and precisely code speech using a single set of thresholds that does not, for example, take into account any adjustment of the background noise. Moreover, these and other prior art techniques are not particularly useful at low bit rates where it is even more difficult to accurately code speech.

Accordingly, there is a need for an improved method for speech coding useful at low bit rates. In particular, there is a need for an improved method for speech coding at high compression whereby the influence from the background noise is considered. Even more particular, there is a need for an improved method for selecting threshold levels in speech coding useful at low bit rates and furthermore, the method considers and uses the background noise for adaptive tuning of the thresholds, or even choosing different speech coding schemes.

SUMMARY OF THE INVENTION

The present invention overcomes the problems outlined above and provides a method for improved speech coding. In particular, the present invention provides a method for improved speech coding particularly useful at low bit rates. More particularly, the present invention provides a robust method for improved threshold setting or choice of technique in speech coding whereby the level of the background noise is estimated, considered and used to dynamically set and adjust the thresholds or choose appropriate techniques.

In accordance with one aspect of the present invention, the signal to noise ratio of the input speech signal is determined and used to set, adapt, and/or adjust both the high level and low level determinations in a speech coding system.

BRIEF DESCRIPTION OF THE DRAWINGS

These and other features, aspects and advantages of the present invention will become better understood with reference to the following description, appending claims, and accompanying drawings where:

DETAILED DESCRIPTION OF PREFERRED EMBODIMENTS

The present invention relates to an improved method for speech coding at low bit rates. Although the methods for speech coding and, in particular, the methods for coding using the signal to noise ratio (SNR) presently disclosed are particularly suited for cellular telephone communication, the invention is not so limited. For example, the methods for coding of the present invention may be well suited for a variety of speech communication contexts, such as the PSTN (public switched telephone network), wireless, voice over IP (Internet protocol), and the like. Furthermore, the performance of speech recognition techniques also are typically influenced by the presence of background noises, the present invention may be beneficial to those applications.

Figure 1:
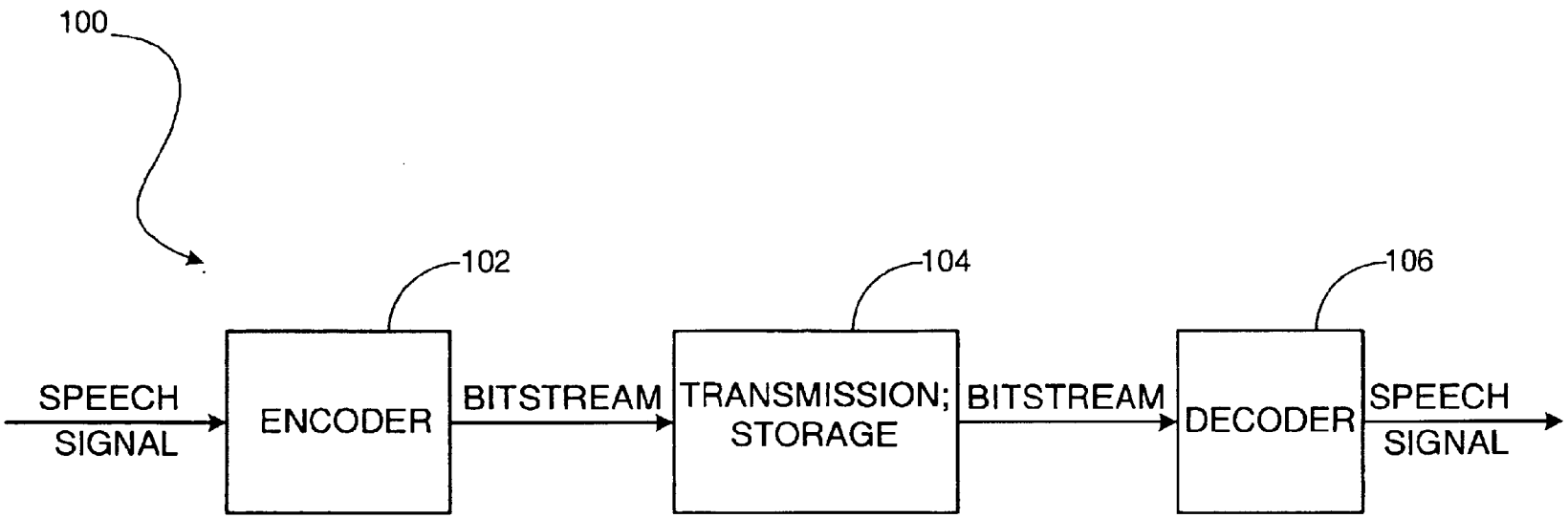
Figure 1 (PRIOR ART)
FIG. 1 illustrates, in block format, a simplified depiction of the typical stages of speech coding in the prior art.

By way of introduction, FIG. 1 broadly illustrates, in block format, the typical stages of speech processing known in the prior art. In general, a speech system 100 includes an encoder 102, a transmission or storage 104 of the bit stream, and a decoder 106. Encoder 102 plays a critical role in the system, especially at very low bit rates. The pre-transmission processes are carried out in encoder 102, such as determining speech from non-speech, deriving the parameters, setting the thresholds, and classifying the speech frame. Typically, for high quality speech communication, it is important that the encoder (usually through an algorithm) consider the kind of signal, and based upon the kind, process the signal accordingly. The specific functions of the encoder of the present invention will be discussed in detail below, however, in general, the encoder incorporates various techniques to generate better low bit rate speech reproduction. Many of the techniques applied are based on characteristics of the speech itself. For example, encoder 102 classifies noise, unvoiced speech, and voiced speech so that an appropriate modeling scheme corresponding to a particular class of signal can be selected and implemented.

The encoder compresses the signal, and the resulting bit stream is transmitted 104 to the receiving end. Transmission (wireless or wire) is the carrying of the bit stream from the sending encoder 102 to the receiving decoder 106. Alternatively, the bit stream may be temporarily stored for delayed reproduction or playback in a device such as an answering machine or voiced email, prior to decoding.

The bit stream is decoded in decoder 106 to retrieve a sample of the original speech signal. Typically, it is not realizable to retrieve a speech signal that is identical to the original signal, but with enhanced features (such as those provided by the present invention), a close sample is obtainable. To some degree, decoder 106 may be considered the inverse of encoder 102. In general, many of the functions performed by encoder 102 can also be performed in decoder 106 but in reverse.

Although not illustrated, it should be understood that speech system 100 may further include a microphone to receive a speech signal in real time. The microphone delivers the speech signal to an A/D (analog to digital) converter where the speech is converted to a digital form then delivered to encoder 102. Additionally, decoder 106 delivers the digitized signal to a D/A (digital to analog) converter where the speech is converted back to analog form and sent to a speaker.

The present invention may be applied to any communication system which is preferably used to build component compression. For example, the CELP (Code Excited Linear Prediction) model quantizes the speech using a series of weighted impulses. The input signal is analyzed according to certain features, such as, for example, degree of noise-like content, degree of spike-like content, degree of voiced content, degree of unvoiced content, evolution of magnitude spectrum, evolution of energy contour, and evolution of periodicity. A codebook search is carried out by an analysis-by-synthesis technique using the information from the signal. The speech is synthesized for every entry in the codebook and the chosen codeword ideally reproduces the speech that sounds the best (defined as being the closest to the original input speech perceptually). Herein, reference may be conveniently made to the CELP model, but it should be appreciated that the method for improved speech coding using the signal to noise ratio disclosed herein are suitable in other communication environments, e.g., harmonic coding and PWI prototype waveform interpolation, or speech recognition as previously mentioned.

Figure 2:
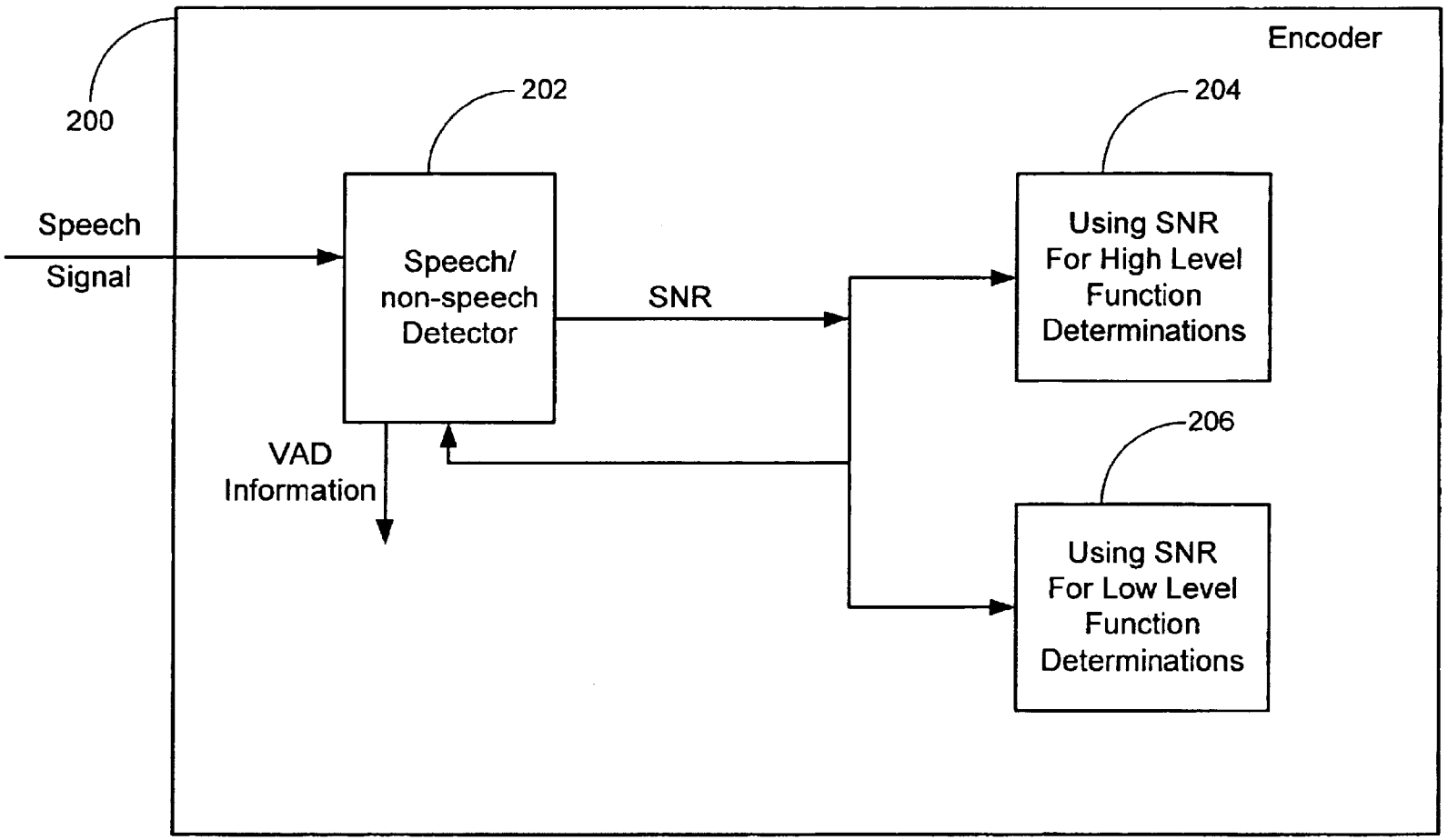
FIG. 2 illustrates, in block detail, an exemplary encoding system in accordance with the present invention.

Referring now to FIG. 2, an encoder 200 is illustrated, in block format, in accordance with one embodiment of the present invention. Encoder 200 includes a speech/non-speech detector 202, a high level function block 204, and a low level function block 206. Encoder 200 may suitably include several modules for encoding speech. Modules, e.g., algorithms, may be implemented in C-code, or any other suitable computer or device program language known in the industry, such as assembly. Herein, many of the modules are conveniently described as high level functions and low level functions and will be discussed in detail below. Further, as used herein, "high level" and "low level" shall have the meaning common in the industry, wherein "high level" denotes algorithmic level decisions, such as use of a particular method, for example, the bit-rate allocation, quantization scheme, and the like; and "low level" denotes parameter level decisions, such as threshold settings, weighting functions, controlling parameter settings, and the like.

The present invention first estimates and tracks the level of ambient noise in the speech signal through the use of a speech/non-speech detector 202. In one embodiment, speech/non-speech detector 202 is a voice activity detection (VAD) embedded in the encoder to provide information on the characteristics of the input signal. The VAD information can be used to control several aspects of the encoder including various high level and low level functions. In general, the VAD, or a similar device, distinguishes the input signal between speech and non-speech. Non-speech may include, for example, background noise, music, and silence.

Various methods for voice activity detection are well known in the prior art. For example, U.S. Pat. No. 5,963,901 presents a voice activity detector in which the input signal is divided into subsignals and voice activity is detected in the subsignals. In addition, a signal to noise ratio is calculated for each subsignal and a value proportional to their sum is compared with a threshold value. A voice activity decision signal for the input signal is formed on the basis of the comparison.

In the present invention, the signal to noise ratio (SNR) of the input speech signal is suitably derived in the speech/non-speech detector 202 which is preferably a VAD. The SNR provides a good measure of the level of ambient noise present in the signal. Deriving the SNR in the VAD is known to those of skill in the art, thus any known derivation method is suitable, such as the method disclosed in U.S. Pat. No. 5,963,901 and the exemplary SNR equations detailed below.

Once the SNR is derived, the present invention considers and uses the SNR in both high level and low level determinations within the encoder. High level function block 204 may include one or more of the "high level" functions of encoder 200. Depending on the level of noise in the input signal, the present inventors have found that it is advantageous to set, adapt, and/or adjust one or more of the high level functions of encoder 200. The VAD, or the like, derives the SNR as well as other possible relevant speech coding parameters. Typically for each parameter, a threshold of some magnitude is considered. For example, the VAD may have a threshold to determine between speech and noise. The SNR generally has a threshold which can be adjusted according to the level of background noise in the signal. Thus, after the VAD derives the SNR, this information is suitably looped back to the VAD to update the VAD's thresholds as needed (e.g., updating may occur if the level of noise has increased or decreased).

Low level function block 206 may include one or more of the "low level" functions of encoder 200. Here, similar to the high level functions, the present inventors have found that by using the SNR as a suitable measure of the level of ambient noise, it is advantageous to set, adapt, and/or adjust one or more of the low level functions of encoder 200.

How much noise is present in the input speech signal can be measured using the signal to noise ratio (SNR) commonly measured in decibels. Generally speaking, the SNR is a measure of the signal energy in relation to the noise energy, and can represented by the following equation:

$$SNR = 10\log_{10}\frac{\overline{E_S}}{\overline{E_N}}\text{dB} \tag{1}$$

where $\overline{E_S}$ is the average signal energy and $\overline{E_N}$ is the average noise energy.

The average energy of the signal and the noise can be found using the following equation:

$$\overline{E} = \sum_{0}^{N-1} (x_n)^2 \tag{2}$$

where $X_n$ is the speech sample at a given time and N is the length period over which energy is computed.

The signal and noise energies can be estimated using a VAD, or the like. In one embodiment, the VAD tracks the signal energy by updating the energies that are above a predetermined threshold (e.g., $T_1$) and tracks the noise energy by updating the energies that are below a predetermined threshold (e.g., $T_2$).

Typically a SNR above 50 dB is considered clean speech (substantially no background noise). SNR values in the range from 0 dB to 50 dB are commonly considered to be noisy speech.

It should be appreciated that disclosed herein are methods for speech coding using SNR, but the equivalent measure of noise to signal ratio (NSR) is suitable for the present invention. Of course equation 1 would be modified by switching the average energies to reflect the NSR. When using the NSR, a high ratio represents noisy speech and a low ratio represents clean speech.

Figure 3:
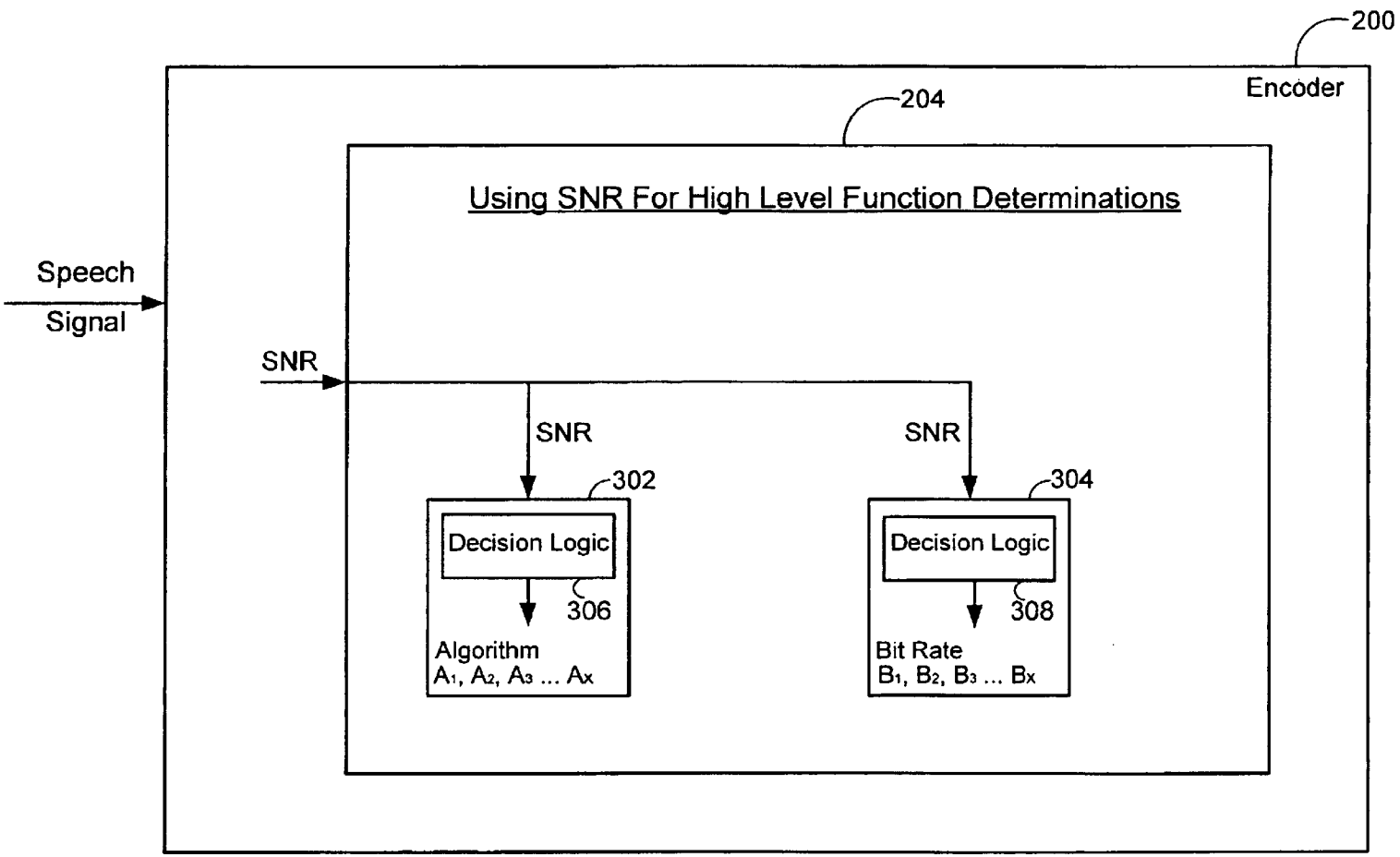
FIG. 3 illustrates, in block detail, exemplary high level functions of an encoding system in accordance with the present invention.

FIG. 3 illustrates, in block format, one exemplary high level function block 204 of encoder 200 in accordance with the present invention. In the present exemplary embodiment, high level function block 204 suitably includes an algorithm module 302 and a bit rate module 304. The present invention considers the SNR of the input speech signal in various high level determinations, e.g., which type of speech coding algorithm is appropriate in a certain level of background noise and which bit rate is appropriate in a certain level of background noise.

There are numerous speech coding algorithms known in the industry. For example, speech enhancement (or noise suppressor), LPC (linear predictive coding) parameter extraction, LPC quantization, pitch prediction (frequency or time domain), $1^{st}$-order pitch prediction (frequency or time domain), multi-order pitch prediction (frequency or time domain), open-loop pitch lag estimation, closed-loop pitch lag estimation, voicing, fixed codebook excitation, parameter interpolation, and post filtering.

In general, speech coding algorithms exhibit different behaviors depending upon the noise level. For example, in clean speech, it is generally known that the LPC gain and the pitch prediction gain are usually high. Therefore, in clean speech, high quality can be achieved by using simple techniques which result in lower computational complexity and/or lower bit-rate. On the other hand, if mid-level noise is detected (e.g., 30–40 dB SNR), it is generally known that a suitable suppressor can substantially remove the noise without damaging the speech quality. Thus, it is often desirable to turn on such a noise suppressor before coding the speech signal in mid-level noisy environments. At high level noise (low SNR, e.g., 0–15 dB), a noise suppressor may significantly damage the speech quality and predictions, such as LPC or pitch, can result in very low gains. Therefore, at high level noise special techniques may be desired to maintain a good speech quality, however at the cost of some increase in complexity and/or bit-rate.

At low bit-rate coding applications, it is also desirable to allocate the available bit budget to the areas that bring the most benefits. For example, if high SNR is detected, and it is known that LPC and pitch gains are high, it is often sensible to allocate more bits to transmit LPC or pitch information. However, for high noise level (low LPC and pitch gains) it is generally not too beneficial to allocate a large bandwidth for transmitting LPC and pitch parameters.

In summary, it is known that some speech coding algorithms perform better under certain conditions. For example, Algorithm #1 may be particularly suited for highly noisy speech, while Algorithm #2 may be better suited for less noisy speech, and so on. Thus, by first determining the level of background noise by, for example, deriving the SNR, the optimum speech coding algorithm can be selected for a certain level of noise.

With continued reference to FIG. 3, algorithm module 302 suitably includes a decision logic 306. Decision logic 306 is suitably designed to compare the noise level, as determined by the SNR, and select the appropriate speech coding algorithm. For example, in one exemplary embodiment, decision logic 306 suitably compares the SNR with a look-up table of speech coding algorithms and selects the appropriate algorithm based on the SNR. In particular, decision logic 306 may suitably include a series of "if-then" statements to compare the SNR. In one embodiment, an "if" statement for decision logic 302 may read; "if SNR is greater than x, then select Algorithm #1." In another embodiment, the statement may read "if y is less than SNR and z is greater than SNR, then select Algorithm #2." In yet another embodiment, the statement may read; "if SNR is less than x, than select Algorithm #3." One skilled in the art can readily recognize that any number of "if-then" statements can be included for a particular communication application.

Once decision logic 302 determines which speech coding algorithm is best suited for the particular speech input, the algorithm is selected and subsequently used in encoder 200. Any number of suitable algorithms may be stored or alternatively derived for selection by decision logic 302 (illustrated generally in FIG. 3 as ($A_1$, $A_2$, $A_3$, . . . $A_x$)).

Another exemplary high level function which is suitably selected depending on the SNR, is the bit rate. Speech is typically compressed in the encoder according to a certain bit rate. In particular, the lower the bit rate, the more compressed the speech. The telecommunications industry continues to move towards lower bit rates and higher compressed speech. The communications industry must consider all types of noise as having a potential effect on speech communication due in part to the explosion of cellular phone users. The SNR can suitably measure all types of noise and provide an accurate level of various types of background noise in the speech signal. The present inventors have found the SNR provides a good means to select and adjust the bit rate for optimum speech coding.

Bit rate module 304 suitably includes a decision logic 308. Decision logic 308 is designed to compare the noise level, as determined by the SNR, and select the appropriate bit rate. In a similar manner as decision logic 306 of algorithm module 302, decision logic 308 may suitably compare the SNR with a look-up table of appropriate bit rates and select the appropriate bit rate based on the SNR. In one embodiment, decision logic 308 includes a series of "if-then" statements to compare the SNR as previously discussed for decision logic 306. One skilled in the art will readily recognize that any number of "if-then" statements may be included for a particular communication application.

Once decision logic 308 determines the bit rate best suited for the particular speech input, the bit rate is selected. Any number of bit rates may be stored or alternatively derived for selection by decision logic 304 (illustrated generally in FIG. 3 as ($B_1$, $B_2$, $B_3$, . . . $B_x$)).

Disclosed herein are a few of the contemplated high level functions which can suitably be controlled by the level of background noise. The disclosed high level functions were not intended to be limiting but rather to be illustrative. There are various other high level functions, such as noise suppressor, use of different speech modeling (e.g., use CELP or PWI), and use of different fixed codebook structures (pulse-like codebooks are good for clean speech, but pseudo-random codebooks are suitable for speech with background noise), which are suitable for the present invention and are intended to be within the scope of the present invention.

Figure 4:
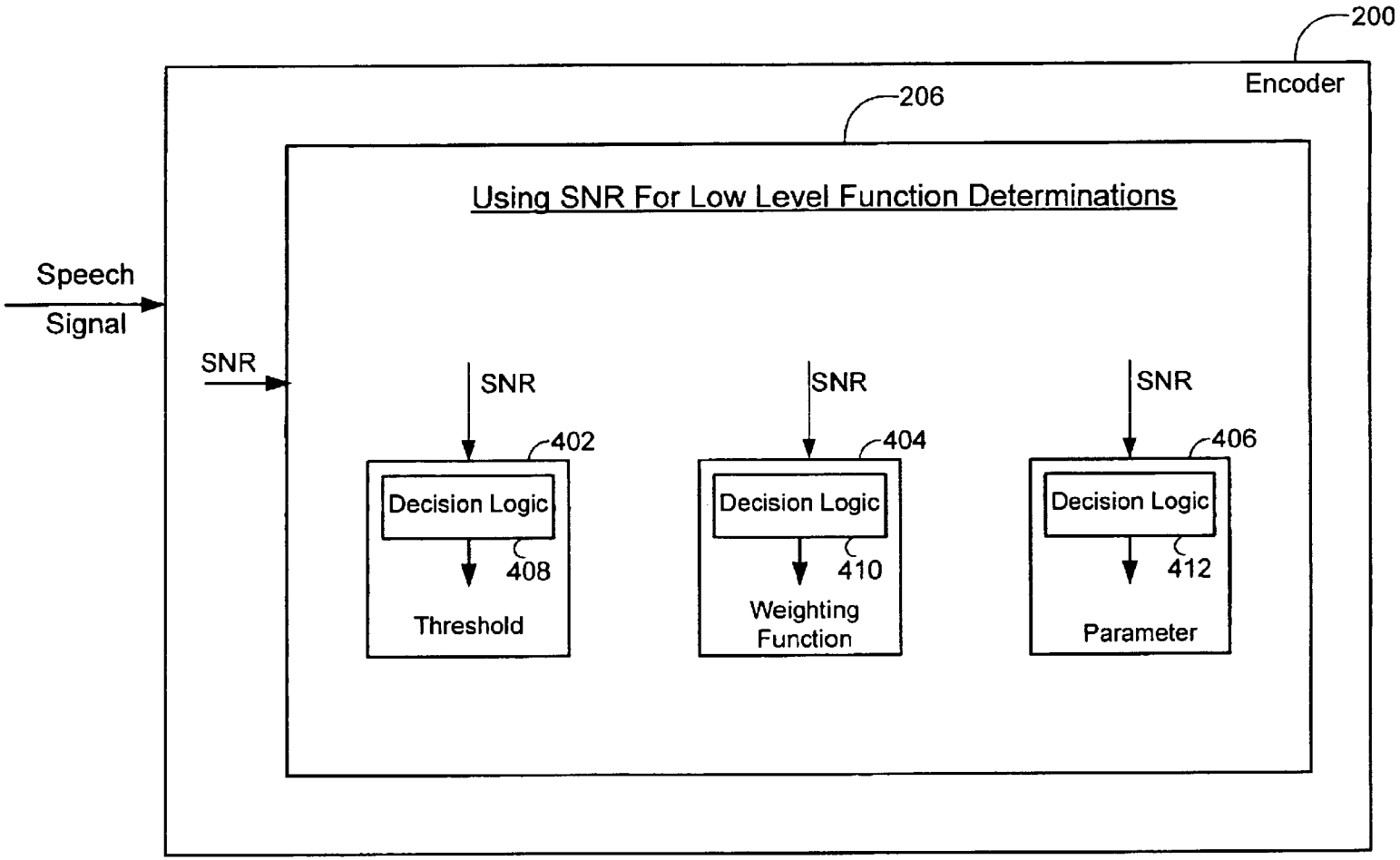
FIG. 4 illustrates, in block detail, exemplary low level functions of an encoding system in accordance with the present invention.

Referring now to FIG. 4, one exemplary low level function block 206 of encoder 200 is illustrated in block format according to the present invention. The present embodiment includes a threshold module 402, a weighting module 404, and a parameter module 406. In a similar manner as previously described for high level function block 204, the present invention considers the SNR of the input speech signal in various low level determinations. Discussed herein are exemplary low level functions that the SNR can be used to suitably set, adapt, and/or adjust. Various other low level functions such as, determining the attenuation level for noise suppressor (high attenuation level, i.e., 10–15 dB, is typical for low SNR, while low attenuation level is sufficient for mid-level SNR), use of different weighting functions or parameter settings in parameter extraction, parameter quantization and/or speech synthesis stages, and changing the decision making process by means of modifying the controlling parameter(s), are contemplated and intended to be within the scope of the present invention.

Typically, an input speech signal is classified into a number of different classes during encoding, for among other reasons, to place emphasis on the perceptually important features of the signal. The speech is generally classified based on a set of parameters, and for those parameters, a threshold level is set for facilitating determination of the appropriate class. In the present invention, the SNR of the input speech signal is derived and used to help set the appropriate thresholds according to the level of background noise in the environment.

Figure 5:
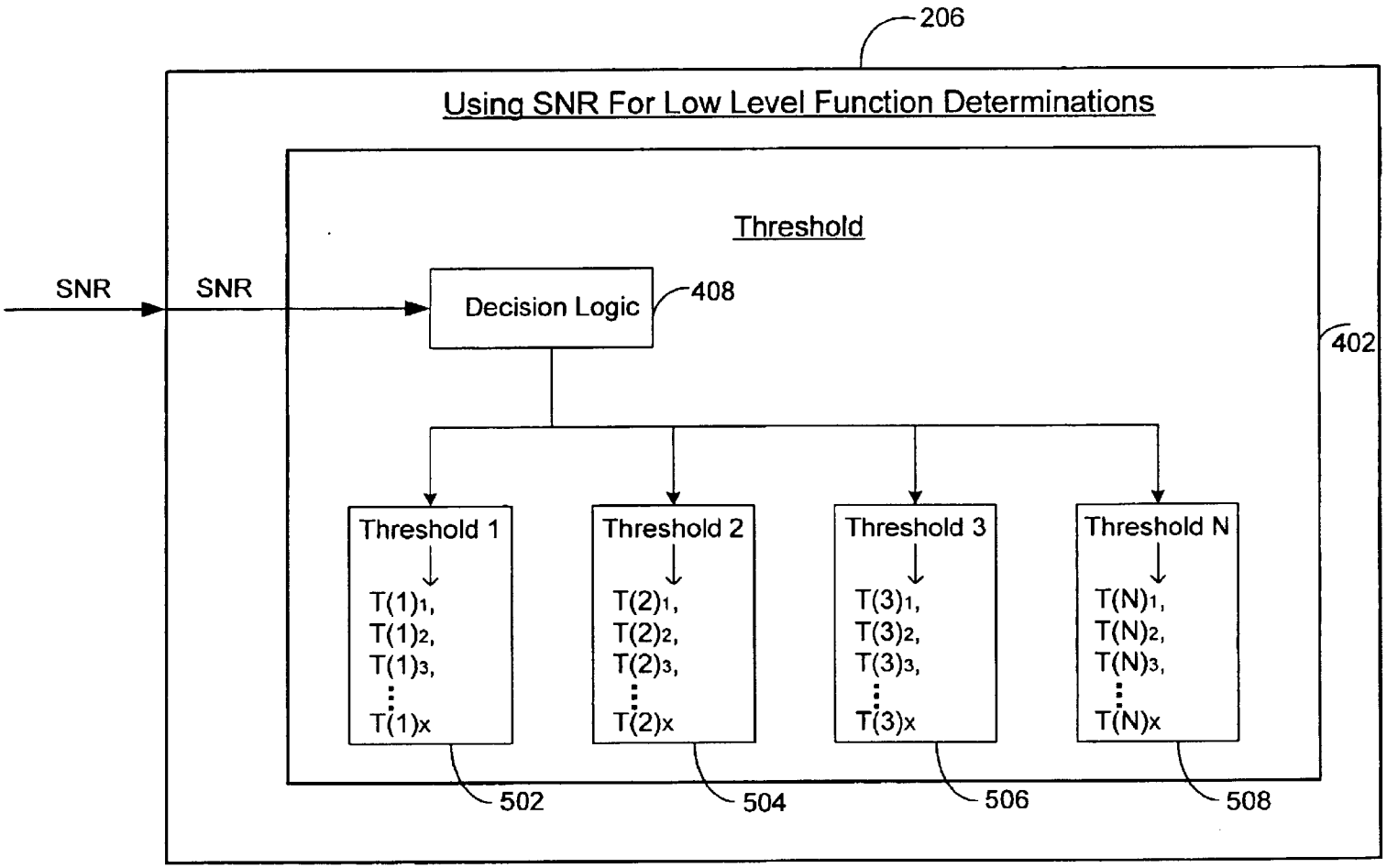
FIGS. 5–7 illustrate, in block detail, one aspect of an exemplary low level function of an encoding system in accordance with the present invention.

FIG. 5 illustrates, in block format, threshold module 402 in accordance with one embodiment of the present invention. Threshold module 402 suitably includes a decision logic 408 and a number of relevant threshold modules 502, 504, 506, 508. For example, thresholds may be set for speech coding parameters such as, pitch estimation, spectral smoothing, energy smoothing, gain normalization, and voicing (amount of periodicity). Any number of relevant thresholds may be set, adapted, and/or adjusted using the SNR. This is generally illustrated in block 508 as "Threshold N."

In general, for each parameter, a threshold level is determined by, for example, an algorithm. The present invention includes an appropriate algorithm in threshold module 402 designed to consider the SNR of the input signal and select the appropriate threshold for each relevant parameter according to the level of noise in the signal. Decision logic 408 is suitably designed to carry out the comparing and selecting functions for the appropriate threshold. In a similar manner as previously disclosed for decision logic 306, decision logic 408 can suitably include a series of "if-then" statements. For example, in one embodiment, a statement for a particular parameter may read; "if SNR is greater than x, then select Threshold #1." In another embodiment, a statement for a particular parameter may read; "if y is less than SNR and z is greater than SNR, then select Threshold #2." One skilled in the art will recognize that any number of "if-then" statements may be included for a particular communications application.

Once decision logic 408 compares the SNR and determines the appropriate threshold according to the level of background noise, the threshold is chosen from a stored look-up table of suitable thresholds (illustrated generally in FIG. 5 as ($T_1$, $T_2$, $T_3$, . . . $T_x$) in block 502). Alternatively, each relevant threshold can be computed as needed. In particular, when threshold module 402 receives the SNR, each relevant threshold is computed using the SNR information. In various applications, the latter technique for selecting the appropriate threshold may be preferred due to the dynamic nature of the, background noise.

As the background noise level changes (i.e., increases and decreases), the SNR changes respectively. Thus, another advantage to the present invention is the adaptability as the noise level changes. For example, as the SNR increases (less noise) or decreases (more noise) the relevant thresholds are updated and adjusted accordingly. Thereby maintaining optimum thresholds for the noise environment and furthering high quality speech coding.

In one embodiment, Threshold #1 502 may be for voicing (amount of periodicity). Periodicity can suitably be ranged from 0 to 1, where 1 is high periodicity. In clean speech (no background noise), the periodicity threshold may be set at 0.8. In other words, "$T_1$" may represent a threshold of 0.8 when there is no background noise. But in corrupted speech (i.e., noisy speech) 0.8 may be too high, so the threshold is adjusted. "$T_2$" may represent a threshold of 0.65 when background noise is detected in the signal. Thus, as the noise level changes, the relevant thresholds can adapt accordingly.

Figure 6:
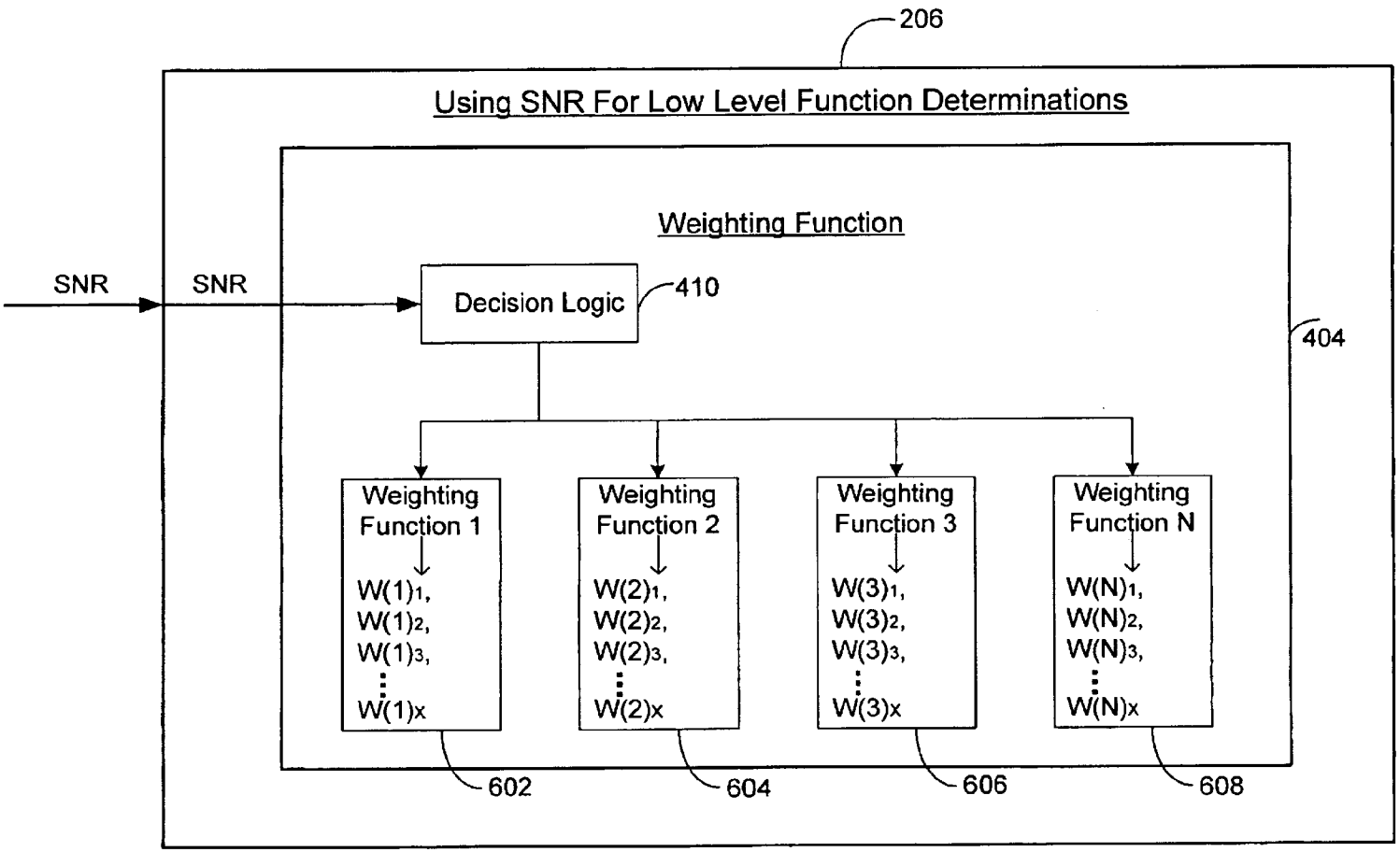

FIG. 6 illustrates, in block format, weighting module 404 in accordance with one embodiment of the present invention. Weighting module 404 suitably includes decision logic 410, and a number of relevant weighting function modules 602, 604, 606, 608. For example, weighting functions 1, 2, 3 . . . N may include pitch harmonic weighting in the parameter extraction and/or quantization processes, amount of weighting to be applied for determining between the pulse-like codebook or the pseudo-random codebook, and usage of different weighted mean square errors for discrimination and/or selection purposes. Any number of weighting functions may be set, adapted, and/or adjusted using the SNR. This is generally illustrated in block 608 as "Weighting Function N."

The present invention uses the SNR to apply different weighting for discrimination purposes. In speech coding, weighting provides a robust way of significantly improving the quality for both unvoiced and voiced speech by emphasizing important aspects of the signal. Generally, there is a weighting formula for applying different weighting to the signal. The present invention utilizes the SNR to improve weighting by deciding between various weighting formulas based upon the amount of noise present in the signal. For example, one weighting function may determine whether energy of the re-synthesized speech should be adjusted to compensate the possible energy loss due to a less accurate waveform matching caused by an increasing level of background noise. In another embodiment, one weighting function may be the weighted mean square error and the different weighting methods and/or weighting amounts may be weighting formulas where the SNR is embedded in the formula. In the exemplary embodiment, decision logic 410 can suitably choose between the various formulas (generally illustrated as $W(1)_1$, $W(1)_2$, $W(1)_3$, . . . $W(1)_x$) depending upon the SNR level in the signal.

Figure 7:
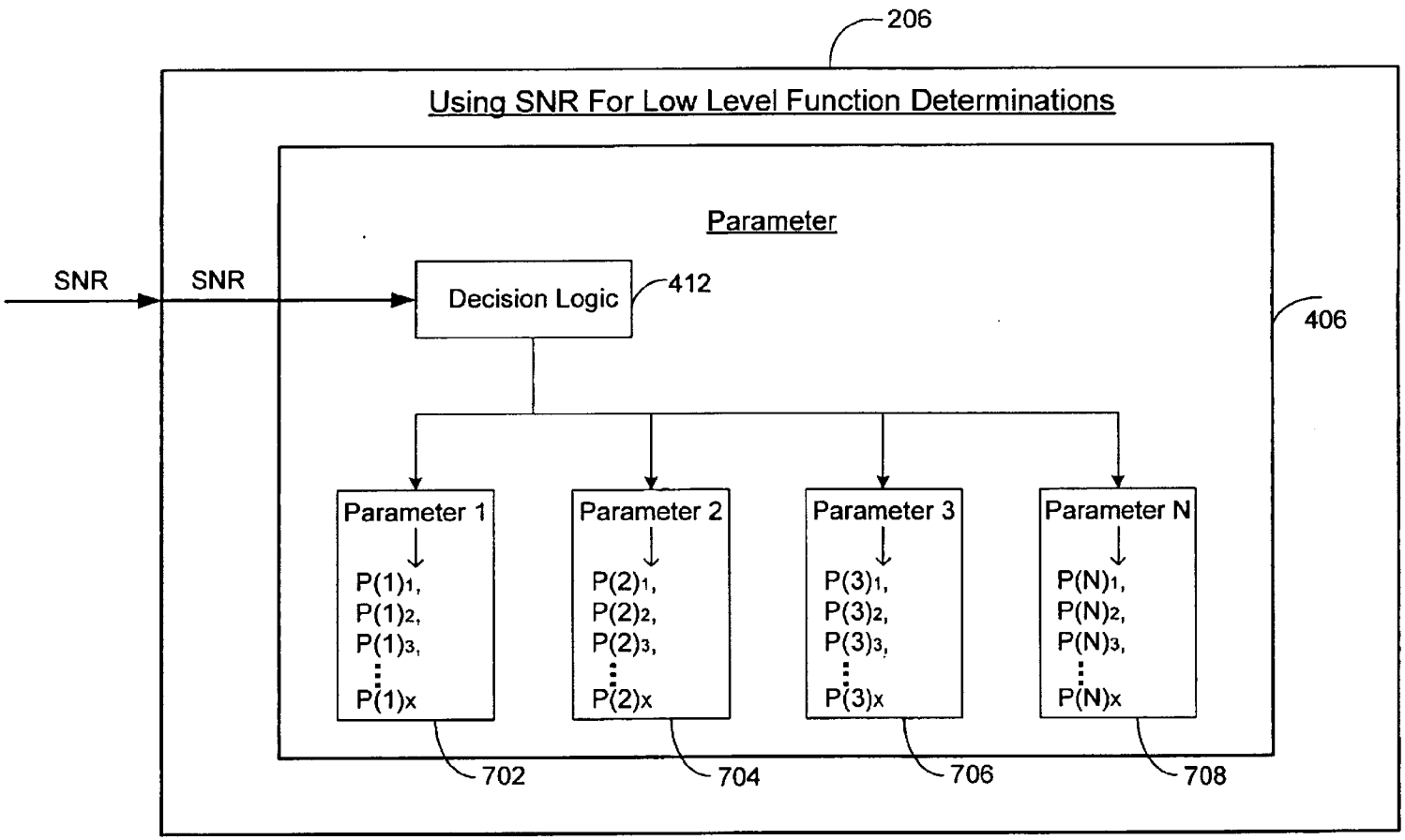

FIG. 7 illustrates, in block format, parameter module 406 in accordance with one embodiment of the present invention. Parameter module 406 suitably includes a decision logic 412 and any number of relevant parameter modules 702, 704, 706, 708. As previously mentioned, speech is typically classified using various parameters which characterize the speech signal. For example, commonly derived parameters include gain, pitch, spectrum, and voicing. Each of the relevant parameters is usually derived with a formula encoded in an appropriate algorithm. Some parameters, however, can be found outside of parameter module 406, such as speech vs. non-speech which is typically determined in a VAD or the like.

Decision logic 412 is designed in a similar manner as previously disclosed for decision logic 306. In particular, decision logic 412 compares the SNR of the input signal and selects the appropriate derivation for a particular parameter. As illustrated in FIG. 7, each parameter can suitably include any number of suitable equations for deriving the parameter (illustrated generally as ($P_1$, $P_2$, $P_3$, . . . $P_x$) in block 702). Decision logic 412 can include, for example, any number or combination of "if-then" statements to compare the SNR. In one embodiment, decision logic 412 selects the appropriate parameter derivation from a stored look-up table of suitable equations. In another embodiment, parameter module 406 includes an algorithm to calculate the suitable equation for a particular parameter using the SNR. In yet another embodiment, the relevant parameter module does not include equations, but rather set values which are selected depending on the SNR.

Background noise is rarely static, but rather changes frequently and in many cases can change dramatically from a high noise level to a low level noise and vice versa. The SNR can reflect the changes in the noise energy level and will increase or decrease accordingly. Therefore, as the level of background changes, the SNR changes respectively. The "newly derived" SNR (due to background noise changes) can be used to reevaluate both the high level and low level functions. For example, in speech communications, especially in the portable cellular phone industry, background noise is extremely dynamic. In one minute, the noise level may be relatively low and the high and low level functions are suitably selected. In a split second the noise level can increase dramatically, thus decreasing the SNR. The relevant high and low level functions can suitably be adjusted to reflect the increased noise, thus maintaining high quality speech coding in a noise dynamic environment.

Figure 8:
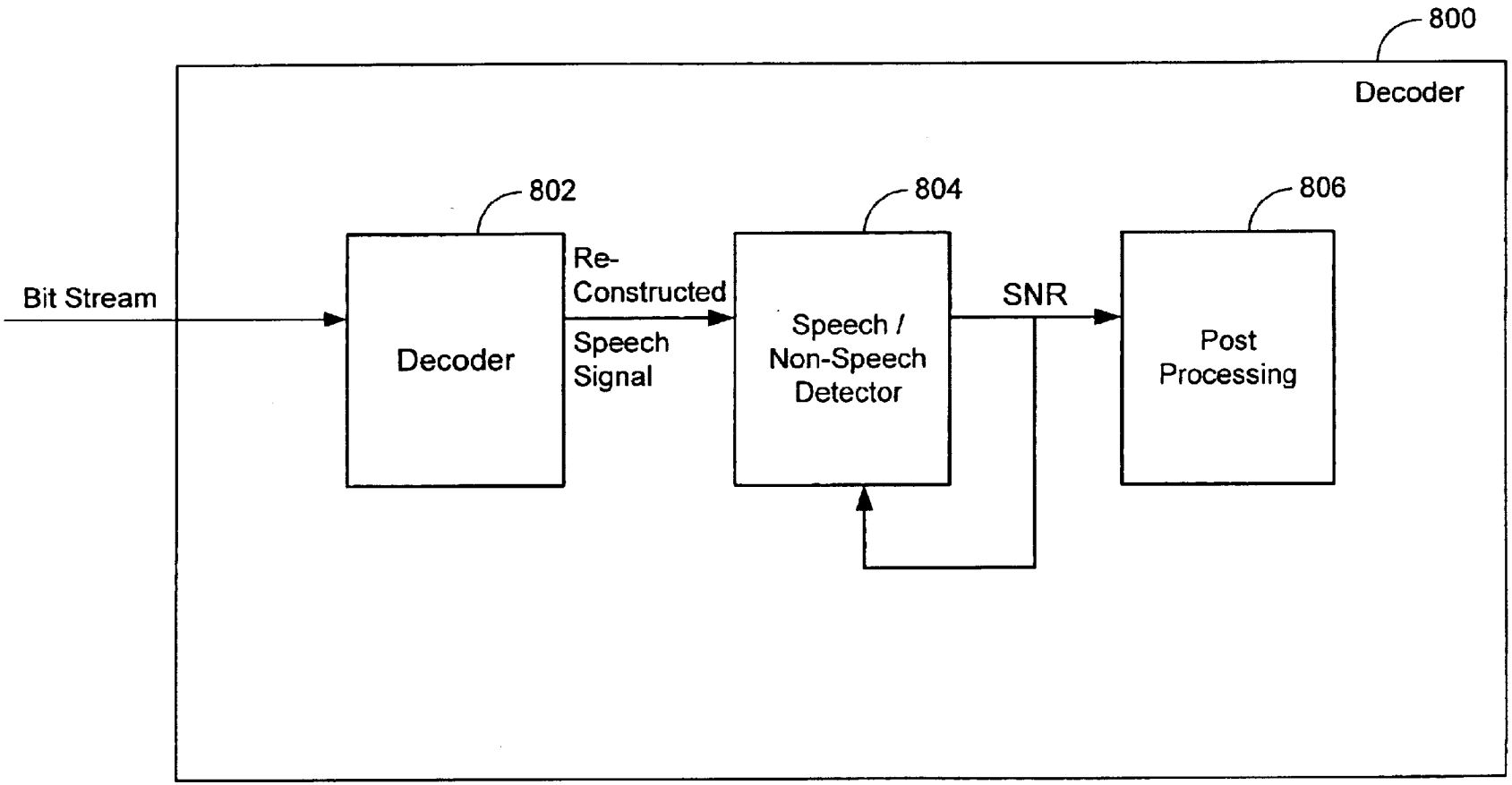
FIG. 8 illustrates, in block detail, an exemplary decoding system in accordance with the present invention.

FIG. 8 illustrates, in block format, a decoder 800 in accordance with an embodiment of the present invention. Decoder 800 suitably includes a decoder module 802, a speech/non-speech detector 804, and a post processing module 806. As illustrated in FIG. 1, the input speech signal leaves encoder 102 as a bit stream. The bit stream is typically transmitted over a communication channel (e.g., air, wire, voice over IP) and enters the decoder 106 in bit stream form. Referring again to FIG. 8, the bit stream is received in decoder module 802. Decoder module 802 generally includes the necessary circuitry to convert the bit stream back to an analog signal.

In one embodiment, decoder 800 includes a speech/non-speech detector 804 similar to speech/non-speech detector 202 of encoder 200. Detector 804 is configured to derive the SNR from the reconstructed speech signal and can suitably include a VAD. In decoder 800, various post processing processes 806 can take place such as, for example, formant enhancement (LPC enhancement), pitch periodicity enhancement, and noise treatment (attenuation, smoothing, etc.). In addition, there are relevant thresholds in the decoder that can be set, adapted and/or adjusted using the SNR. The VAD, or the like, includes an algorithm for deriving some of the parameters, such as the SNR. The SNR has a threshold which can be adjusted according to the level of background noise in the signal. Thus, after the VAD derives the SNR, this information is looped back to the VAD to update the VAD's thresholds as needed (e.g., updating may occur if the level of noise has increased or decreased).

The present invention is described herein in terms of functional block components and various processing steps. It should be appreciated that such functional blocks may be realized by any number of hardware components configured to perform the specified functions. For example, the present invention may employ various integrated circuit components, e.g., memory elements, digital signal processing elements, logic elements, look-up tables, and the like, which may carry out a variety of functions under the control of one or more microprocessors or other control devices. In addition, those skilled in the art will appreciate that the present invention may be practiced in conjunction with any number of data transmission protocols and that the system described herein is merely an exemplary application for the invention.

It should be appreciated that the particular implementations shown and described herein are illustrative of the invention and its best mode and are not intended to otherwise limit the scope of the present invention in any way. Indeed, for the sake of brevity, conventional techniques for signal processing, data transmission, signaling, and network control, and other functional aspects of the systems (and components of the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical communication system.

The present invention has been described above with reference to preferred embodiments. However, those skilled in the art having read this disclosure will recognize that changes and modifications may be made to the preferred embodiments without departing from the scope of the present invention. For example, similar forms may be added without departing from the spirit of the present invention. These and other changes or modifications are intended to be included within the scope of the present invention, as expressed in the following claims.

What is claimed is:

1. A method of estimating a plurality of speech parameters of a speech signal for coding said speech signal using one of a plurality of speech coding algorithms, said plurality of speech parameters including pitch information, said plurality of speech parameters being calculated using a plurality of thresholds, said method comprising:

estimating a background noise level in said speech signal to determine a signal to noise ratio (SNR) for said speech signal;

adjusting one or more of said plurality of thresholds based on said SNR to generate one or more SNR adjusted thresholds;

analyzing said speech signal to extract said pitch information using said one or more SNR adjusted thresholds; and repeating said estimating, said adjusting and said analyzing to code said speech signal using one of said plurality of speech coding algorithms.

2. The method of claim 1 further comprising: selecting said one of said plurality of speech coding algorithms based on said SNR.

3. The method of claim 2, wherein said selecting includes choosing a different codebook structure based on said SNR.

4. The method of claim 2, wherein said selecting includes choosing a different bit rate based on said SNR for coding said speech signal.

5. The method of claim 1, wherein said one or more SNR adjusted thresholds includes a periodicity threshold.

6. The method of claim 1 further comprising: adjusting a pitch harmonic weighting parameter based on said SNR to generate an SNR adjusted pitch harmonic weighting parameter.

7. A speech coding system capable of estimating a plurality of speech parameters of a speech signal for coding said speech signal using one of a plurality of speech coding algorithms, said plurality of speech parameters including pitch information, said plurality of speech parameters being calculated using a plurality of thresholds, said speech coding system comprising:

a background noise level estimation module configured to estimate background noise level in said speech signal to determine a signal to noise ratio (SNR) for said speech signal;

a threshold adjustment module configured to adjust one or more of said plurality of thresholds based on said SNR to generate one or more SNR adjusted thresholds;

a speech signal analyzer module configured to analyze said speech signal to extract said pitch information using said one or more SNR adjusted thresholds; and wherein said background noise level estimation module, said threshold adjustment module and said speech signal analyzer module repeat estimating background noise level, adjusting one or more of said plurality of thresholds and analyzing said speech signal to code said speech signal using one of said plurality of speech coding algorithms.

8. The speech coding system of claim 7, wherein said one of said plurality of speech coding algorithms is selected based on said SNR.

9. The speech coding system of claim 8, wherein a different codebook structure is selected based on said SNR.

10. The speech coding system of claim 8, wherein a different bit rate based is selected on said SNR for coding said speech signal.

11. The speech coding system of claim 7, wherein said one or more SNR adjusted thresholds includes a periodicity threshold.

12. The speech coding system of claim 7, wherein a pitch harmonic weighting parameter is adjusted based on said SNR to generate an SNR adjusted pitch harmonic weighting parameter.

* * * * *